US005327595A

United States Patent [19]

Allen

[11] Patent Number: 5,327,595

[45] Date of Patent: Jul. 12, 1994

[54] BEDCLOTHES RETAINER DEVICES

[76] Inventor: Robert D. Allen, 2704 4th St., NW 2E, Canton, Ohio 44708

[21] Appl. No.: 146,322

[22] Filed: Nov. 2, 1993

Related U.S. Application Data

[63] Continuation-in-part of Ser. No. 67,024, May 26, 1993, abandoned.

[51] Int. Cl.[5] ..... A47G 9/04; A47G 9/02

[52] U.S. Cl. ..... 5/460; 5/496; 5/922; 5/504.1; 24/72.5

[58] Field of Search ..... 5/496, 498, 460, 504.1, 5/658, 505.1, 497, 495, 922, 494; 24/72.5

[56] References Cited

U.S. PATENT DOCUMENTS

| | | | |
|---|---|---|---|
| 1,742,064 | 12/1929 | Dinstuhl | 5/498 |
| 2,024,050 | 12/1935 | May | 5/498 |
| 2,188,576 | 1/1940 | Mulloy | 24/72.5 |
| 2,264,064 | 11/1941 | Breslauer | 5/460 |
| 2,727,565 | 3/1955 | Moser | 5/498 |
| 2,923,014 | 2/1960 | Hume | 5/498 |
| 2,930,053 | 3/1960 | Nowels et al. | 5/498 |
| 3,143,747 | 8/1964 | McSorley et al. . | |
| 3,613,133 | 10/1971 | Isola et al. | 5/482 |
| 3,621,498 | 11/1971 | Cooper | 5/498 |
| 4,199,830 | 4/1980 | Ogata | 5/498 |
| 4,274,169 | 6/1981 | Standiford | 5/502 |
| 4,506,398 | 3/1985 | Hruban | 5/498 |
| 4,662,016 | 5/1985 | Seeman | 5/498 |
| 4,698,880 | 10/1987 | Hamm | 5/498 |
| 4,703,529 | 11/1987 | Mann | 5/496 |
| 4,736,478 | 4/1988 | Dangerously | 5/496 |
| 4,884,305 | 12/1989 | Blackmon | 5/496 |
| 5,072,470 | 12/1991 | Lysiak | 5/498 |

FOREIGN PATENT DOCUMENTS

| | | | |
|---|---|---|---|
| 0275440 | 8/1927 | United Kingdom | 5/498 |
| 0314254 | 6/1929 | United Kingdom | 5/498 |
| 727270 | 3/1955 | United Kingdom | 5/498 |
| 2023419 | 1/1980 | United Kingdom | 5/498 |

*Primary Examiner*—Alexander Grosz
*Attorney, Agent, or Firm*—Paul E. Milliken; Lee A. Germain

[57] ABSTRACT

A device for retaining bedclothes in position on a bed by use of one or more bands transversely encircling a mattress and a band extending around the foot end of a set of box springs to hold a top sheet and/or other item of bedclothes having a retaining flap in a fixed position at the foot of the bed. The band can be elastic or non-elastic.

18 Claims, 6 Drawing Sheets

BEDCLOTHES RETAINER DEVICES

RELATED APPLICATIONS

This application is a continuation-in-part of Ser. No. 08/067,024 filed May 26, 1993 and now abandoned.

FIELD OF THE INVENTION

This invention relates to a device for holding bedclothes in a fixed position on a bed in relationship to the mattress.

BACKGROUND OF THE INVENTION

When a bed is being slept in, bed covers such as sheets, blankets and spreads tend to move off the side or the end of the bed. This is particularly true when the person using the bed is the type of sleeper that tends to toss and turn a great deal of time during the night. Devices have been proposed in the past for holding bedclothes in position on the bed.

One such device may be seen in U.S. Pat. No. 2,024,050 issued to W H May in which a strap having elastic portions extends beneath the mattress and up each side of the mattress and has snaps at each end which engage mating snap portions attached to the bedstead.

Other devices are shown in U.S. Pat. Nos. 2,923,014 issued to G B Hume, 2,930,053 issued to R W Kowels, 4,662,016 issued to R D Seeman, 4,698,880 issued to J A Hamm, and 5,072,470 issued to P J Lysiak, Most of these devices extend across the bottom of the mattress and lie between the mattress and the springs and have end fasteners which grip the edge of the sheet in some manner. Hume shows two different embodiments in which an assembly of straps form a retaining ring on the bottom of the mattress into which the edges of the sheet may be tucked for retention in position on the mattress.

Some of the prior art devices are rather complex in design and cumbersome to mount with respect to the mattress and sheet. Other devices grip the sheet in a manner which will tend to wear holes in the sheet or may allow the sheet to slip of the fastening device.

OBJECTS OF THE INVENTION

It is an object of this invention to provide a simple inexpensive device for retaining bedclothes in a fixed position on the mattress.

Another object of the invention is to provide a bedclothes retaining device which is easy to install in an operative position and to remove from engagement from the bedclothes.

Still another object of this invention is to provide a bedclothes retaining system which engages both a lower and upper bedsheet to hold them in a fixed position with respect to a mattress.

An even further object of this invention is to provide a bedclothes retaining system which will not wear or damage the bedclothing with which it is used.

These and other objects of the invention will become more fully apparent in the following specification and the attached drawings.

SUMMARY OF THE INVENTION

A bedclothes retainer device in combination with an item of bedclothes of substantially rectangular shape for placement on a mattress and having a top edge, a bottom edge and a pair of side edges, the retainer device comprising a retaining flap of flexible sheet material having one edge attached to the item of bedclothes along a transverse line located in relative relationship to the bottom edge of the item of bedclothes and extending from the attached edge in the same direction as the bottom edge said flap having a transverse elongated pocket extending along the opposite edge of the flap, and an elongated filler member removeably positioned within the pocket to form an elongated transverse rib configuration of greater thickness than the sheet material of the flap, the retaining flap extending a sufficient distance relative to the bottom edge of the item of bedclothes that when the item of bedclothes is placed in operative position on a mattress, it will extend down over the bottom edge of the mattress and between the mattress and spring.

DESCRIPTION OF THE PREFERRED EMBODIMENTS

Figure 1:
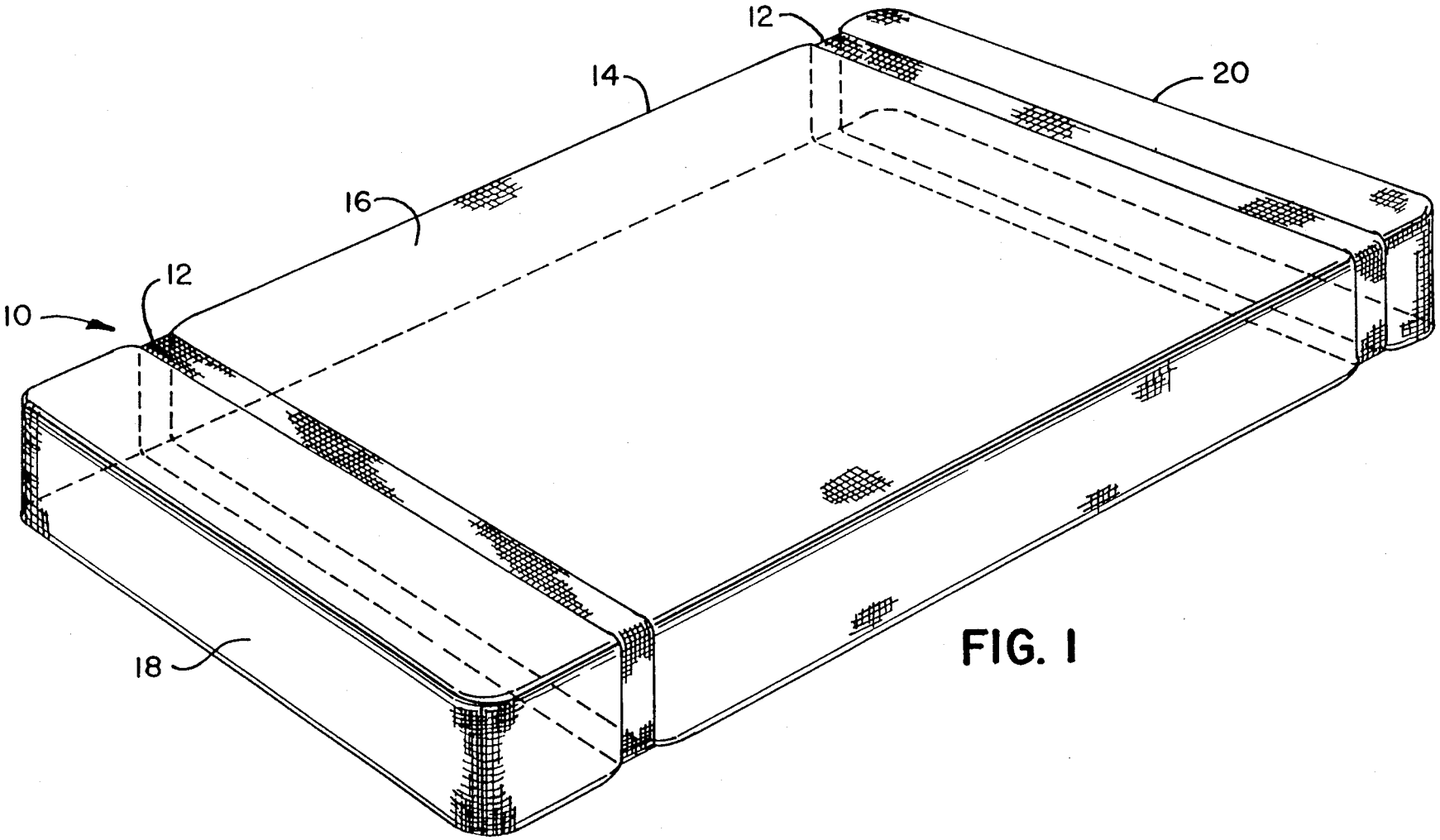
FIG. 1 is a perspective view of a mattress covered by a bottom sheet being retained by one embodiment of the invention.

Referring to the drawings and in particular to FIG. 1, a bedsheet retainer device is indicated in general by the numeral 10 which comprises a pair of substantially identical retaining bands 12 encircling a mattress 14 covered by a bottom sheet 16. One of the bands 12 is located near the foot end 18 and the other band 12 is located near the head end 20 of the mattress 14. In instances with some users the sheet may pull out more readily at the foot of the bed and the band 12 will only be needed at the foot end of the mattress 14.

Figure 2:
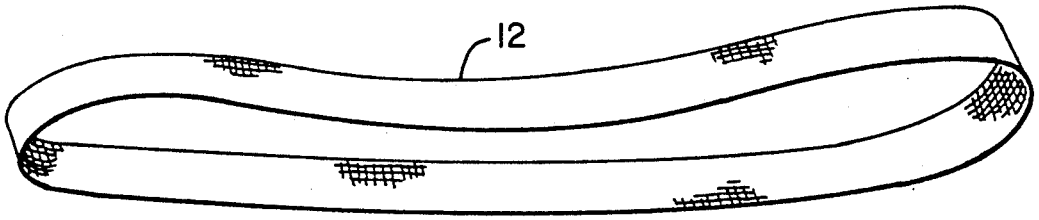
FIG. 2 is a perspective view of a continuous retaining band of the embodiment of the invention shown in FIG. 1.

The band 12 is a continuous elastic band of the type shown in FIG. 2.

Figure 3:
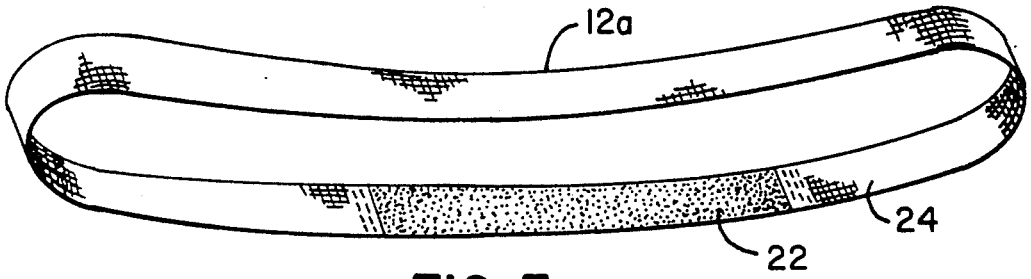
FIG. 3 is a perspective view of another modification of the retaining band shown in FIG. 2 in which part of the band is elastic and part is non-elastic.

FIG. 3 shows another modified band 12*a* wherein the band has an elastic portion 22 and a non-elastic portion 24 joined together to form a continuous band.

Figure 4:
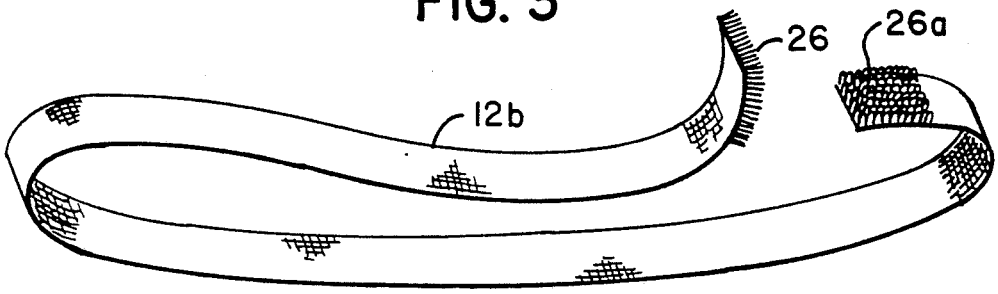
FIG. 4 is a perspective view of another modification of the retaining band shown in FIG. 2 wherein the band is non-continuous but has an attachment device at each end to join the ends of the band together.

FIG. 4 shows a non-continuous band 12*b* having end connecting hooks 26 on one end and connecting loops 26*a* on the opposite end so that after the band 12*b* is placed around the mattress 14 as shown in FIG. 1, and pulled snug to hold the sheet 16 the hooks 26 and loops 26*a* sticks together to fasten the ends together. This type of end connector is sold under the trademark, VELCRO. If desired, the band 12*b* can have an elastic portion similar to the portion 22 of the band 12*a*, however this in not essential since the band is non-continuous and can be pulled tight against the sheet 16 before fastening the ends.

Figure 5:
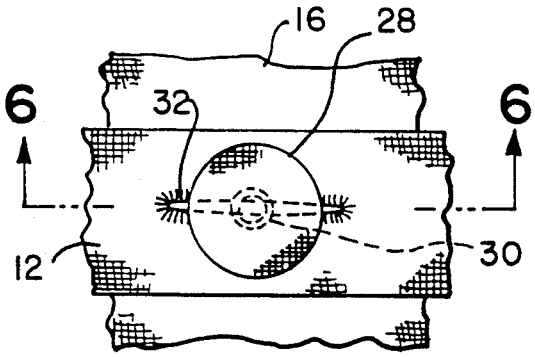
FIG. 5 is a fragmentary plan view of a button-like fastening device for engaging a buttonhole in the retaining band of the invention.
Figure 6:
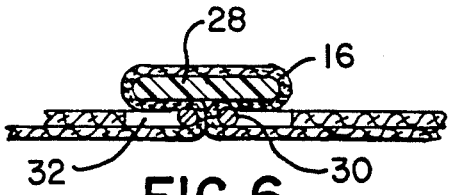
FIG. 6 is a cross-section taken on line 6—6 of FIG. 5.

While the bands 12, 12*a* or 12*b* should normally exert enough pressure against the sheet 16 to hold it in position, if additional retention of the sheet is desired, the fastener device shown in FIGS. 5 and 6 uses a disk shaped button 28 around which a portion of the sheet 16 is wrapped and which is held in position by a retainer ring 30 which can be either an elastic band or a wrapped cord material. The button 28 is passed through a button hole 32 sewn in an appropriate location in the band 12.

An alternative fastening means to the button 28 is the use of snaps 34 having one part attached to the band 12 and the other part attached to the sheet 16.

Figure 8:
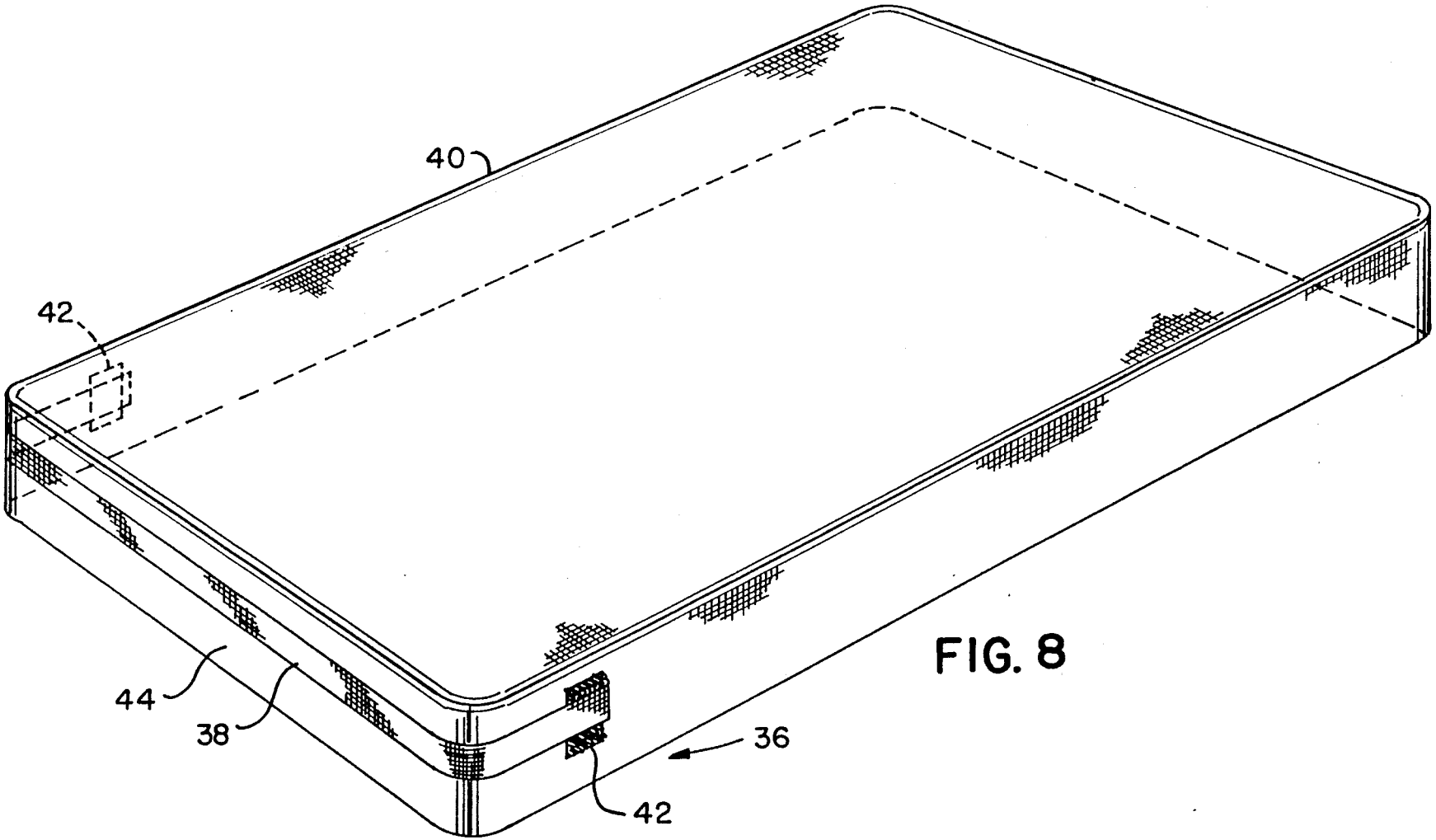
FIG. 8 is another embodiment of the invention wherein a retaining band is attached to the sides of box springs and passes around the foot end of the springs to engage a top sheet or other bedclothing.

While the band 12 or alternative bands 12*a* or 12*b* hold a bottom sheet 16 in position on the mattress 14 another retaining device 36 shown in FIG. 8 is for holding a top sheet and other bedclothes. The device 36 is a band 38 attached to the sides of a box springs 40 by a hook and loop type fastener 42 having one part such as a hook part on the ends of the band 38 and a loop part attached to the sides of the box springs 40. The band 38 may be elastic, non-elastic or part elastic. The band 38 extends around the foot edge 44 of the box springs 40. While for simplicity, a sheet is not shown on the box springs 40 in FIG. 8, in use the bottom or foot portion of a top sheet would be tucked beneath the band 38 and would be held between the band 38 and the foot edge 44 of the box springs 40.

Figure 9:
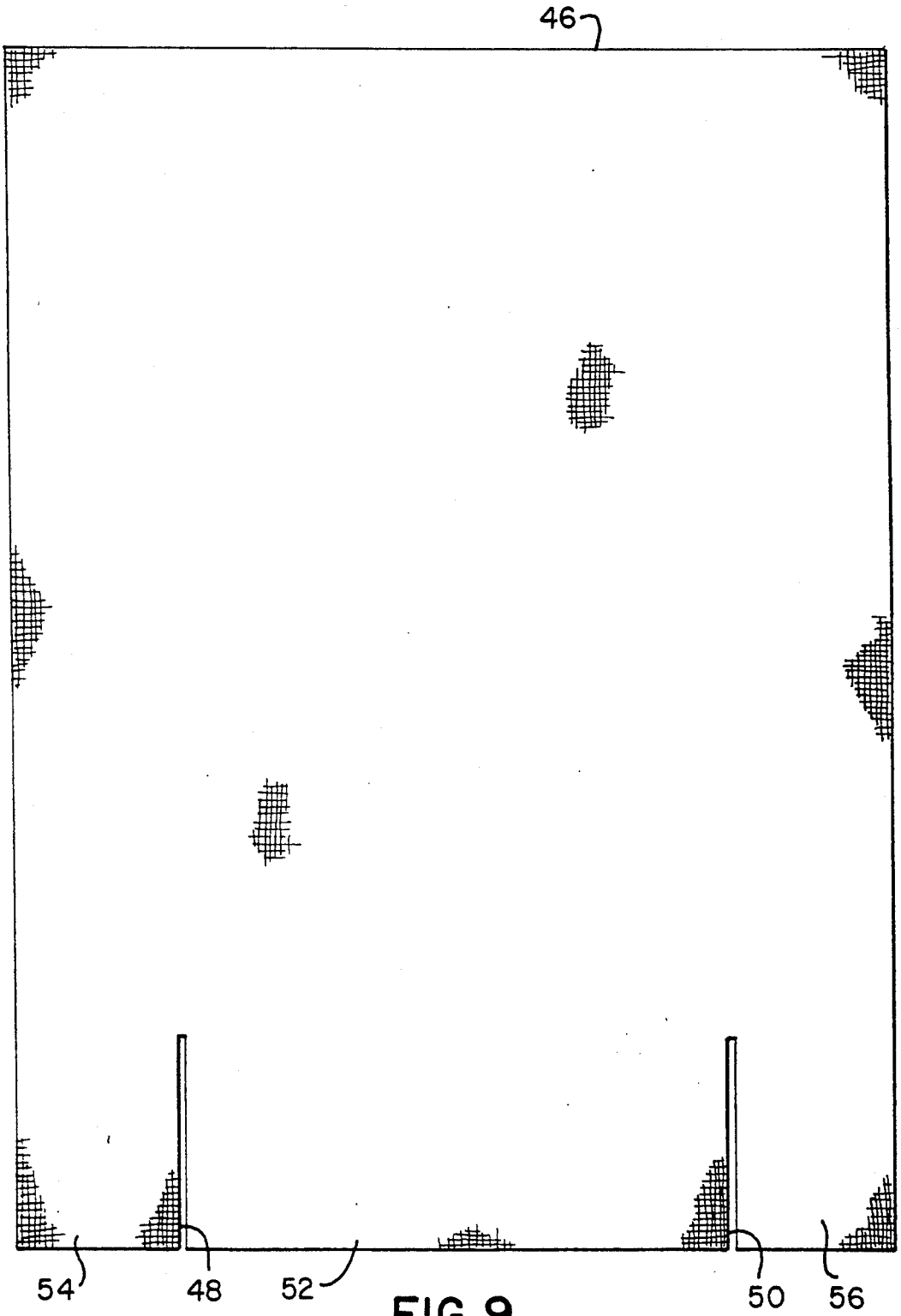
FIG. 9 is a top bedsheet with special slots for receiving the retaining band shown in FIG. 8.

A special top sheet 46 shown in FIG. 9 having slots 48 and 50 defining a center flap 52 therebetween at the foot of the sheet is especially well suited for use with the band 38. The flap 52 can be tucked beneath the band 38 and the outer flaps 54 and 56 can be tucked under the box springs 40.

Figure 7:
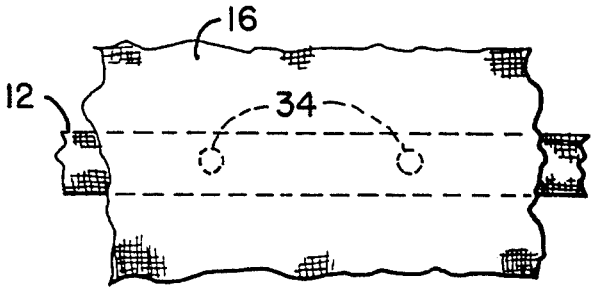
FIG. 7 is a fragmentary plan view of another modification of the invention wherein snap fasteners are used to attach a retaining band to a bedsheet.

It will be recognized that the bands 12, 12*a* or 12*b* as used with the mattress 14 and/or the band 38 as used with the box springs 40 can either be used separately on a bed or together in combination. The bands 12, 12*a* or 12*b* and the band 38 can be sold individually or together as a kit for installation on a mattress and box springs. The kit can include the buttons 28 as shown in FIGS. and 6 and any other variation of fastener for attaching the sheet to the retaining band. It should also be understood that the buttons 28 or the snaps 34 shown in FIG. 7 can be used on either the band 12 or the band 38 so long as the respective band is equipped either with buttonholes or snaps.

Figure 10:
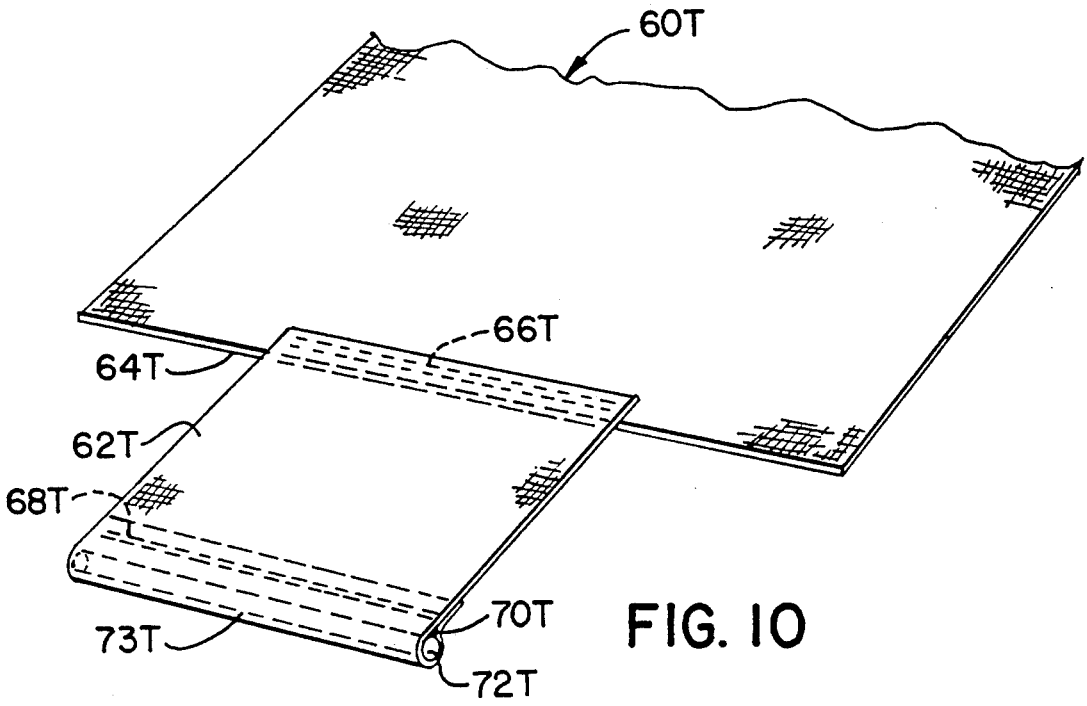
FIG. 10 is a fragmentary perspective view of another modification of a top sheet having a retaining flap at its bottom edge.
Figure 11:
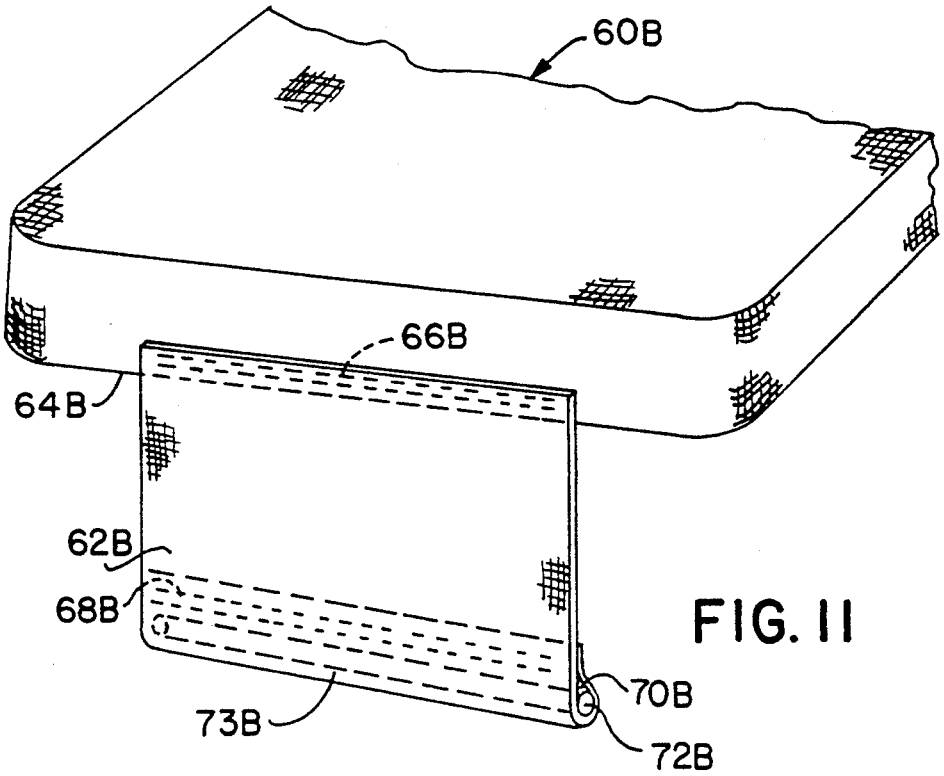
FIG. 11 is a fragmentary perspective view of a bottom fitted type sheet having an retaining flap at its bottom edge.

While the slotted top sheet 46 shown in FIG. 9 will work well with the retaining strap 38 shown in FIG. 8, the top sheet 60T and fitted bottom sheet 60B shown in FIGS. 10 and 11 respectively will work quite well with the retaining bands of the type shown in FIG. 1.

The top sheet 60T has an retaining flap 62T attached to the bottom edge 64T by rows of threads 66T or by other suitable means. The flap 62T can also be formed integrally with the sheet 60T. The opposite end of the flap 62T is folded over and seamed with rows of threads 68T to form a transverse elongate pocket 70T which receives an elongated filler member 72T, made preferably of light weight material such as a cardboard tube or other material. The filler member 72T is removed when the sheet is laundered.

The sheet 60B and retaining flap 62B in FIG. 11 are identical to the sheet 60T and flap 62T except that it is a fitted bottom sheet. For simplicity like parts will bear similar numerals, however sheet 60B will not be described in detail.

Figure 12:
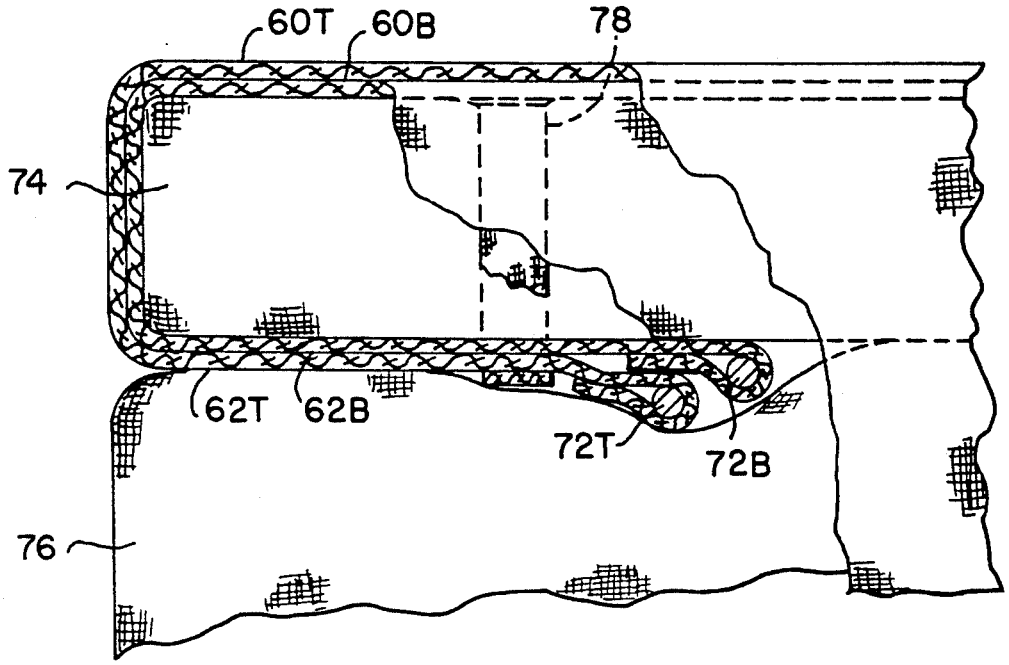
FIG. 12 is a fragmentary side view of a mattress and box spring with portions broken away to show the sheets of FIGS. 10 and 11 placed in operative position on the mattress.

In FIG. 12 the sheets 60T and 60B are shown placed in operative position on a mattress 74 and box spring 76. The retaining flaps 62T and 62B are tucked under the mattress 74 and beneath the retaining band 78 which encircles the mattress. The filler members 72T and 72B form enlarged rib portions 73T and 73B in the ends of the flaps 62T and 62B which prevent the flaps from being pulled past the retaining band 78. Thus both top the sheet 60T and bottom sheet 60B are retained securely at the bottom of the mattress 74.

It should also be recognized that the bottom sheet 60B can also have an extension flap at the top edge of the sheet if additional retention capability is desired at that end of the sheet.

It should be recognized that the use of extension flaps in combination with retaining bands could be used not only on sheets, but blankets or any other type of bedclothes.

Figure 13:
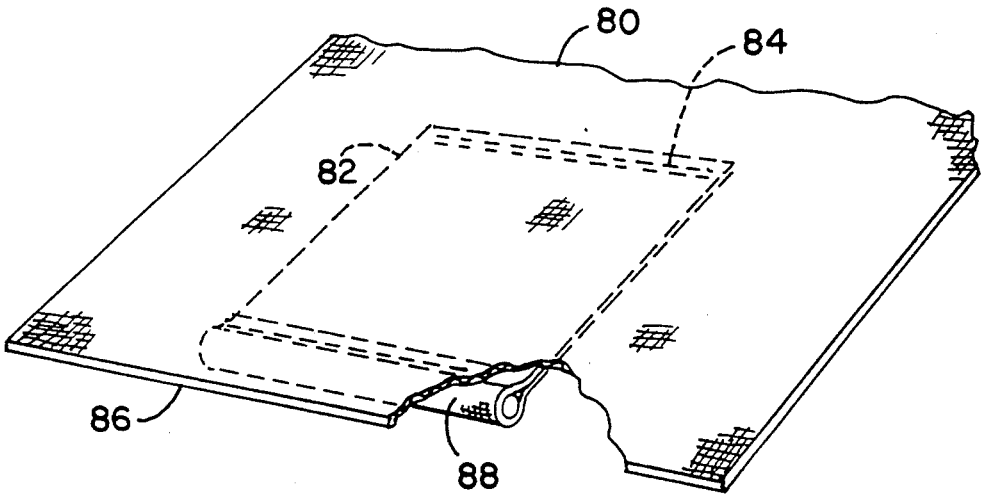
FIG. 13 is a fragmentary perspective view of another embodiment of the invention showing a different arrangement of retaining flap.

The embodiment shown in FIG. 13 is useful with an item of bedclothes where it is desired to allow the bottom end of the item hang down from the bottom end of the mattress rather than tucking it under the mattress. In FIG. 13 a sheet 80 has a retaining flap 82 attached to the bottom surface of the sheet by rows of threads 84 at a spaced distance from the bottom edge 86 of the sheet 80. The flap 82 has a thickened transverse rib 88 formed in a similar manner to those shown in FIGS. 10 and 11. In this embodiment, the flap 82 is tucked between the mattress and spring while the bottom end of the sheet 80 hangs loosly down from the bottom end of the mattress. This same embodiment can be used with blankets spreads or other bedclothes.

The embodiments shown in FIGS. 10 through 13 can also be used without the band 78 if the retainer flap is tucked between the mattress and the spring. The retaining band 78 will, however, provide additional retention capability.

These and various other modifications may be made to the devices shown herein without departing from the scope of the invention.

I claim:

1. A bedsheet retainer kit to removeably secure bedsheets in position on a mattress positioned on a box spring, said kit comprising:

(A) at least one elongated flexible first band means of sufficient length to transversely encircle a mattress adjacent at least one end thereof;

(B) each said first band means being of such configuration as to apply an inward compressive force upon the mattress at all locations where the band means overlies the mattress when the band is in operative position on the mattress;

(C) each said first band means having a bedsheet engaging means to limit relative movement between the sheet, the band and the mattress;

(D) an open ended second band means having an attachment means on each end which are adapted to be attached to mating attachment means fixedly attached on each side of the box spring near the bottom end thereof, said second band means when mounted in operative position extending around the end of the box spring being adapted to engage a top sheet and retain it in a fixed position relative to the mattress and box springs; and (F) a top sheet having a pair of slots at one end thereof, said slots defining a flap therebetween which flap is adapted to lie over the foot end of the mattress and box spring when the top sheet is positioned on the mattress and which flap is held against the box spring when the band is positioned around the foot end of the box spring and attached thereto.

2. A kit as claimed in claim 1 wherein the first band means is a continuous loop and is comprised of at least one extensible portion and at least one non-extensible portion.

3. A kit as claimed in claim 1 wherein the first band means is a continuous loop of extensible material.

4. A kit as claimed in claim 1 wherein the first band means is non-continuous with two opposite ends and includes a fastening means on both ends for removeably attaching the ends together to form a continuous loop after placing the band transversely around the mattress.

5. A bedsheet retainer device in combination with a box spring and top sheet to removeably secure the top sheet in position on a mattress positioned on said box spring having a head end and a foot end, said device comprising: an open ended band having an attachment means on each end which are adapted to be attached to mating attachment means fixedly attached on each side of the box spring near the foot end thereof, said band when mounted in operative position extending around the foot end of the box spring to engage the top sheet and retain it in a fixed position relative to the mattress and box spring, said top sheet having a pair of slots at one end thereof, said slots defining a flap therebetween which flap is adapted to lie over the foot end of the mattress and box spring when the top sheet is positioned on the mattress and which flap is held against the box spring when the band is positioned around the foot end of the box spring and attached thereto.

6. A device as claimed in claim 5 wherein the attachment means on each end of the band and on the box springs are coacting pieces of hook and loop material.

7. A bedclothes retainer device in combination with an item of bedclothes of substantially rectangular shape for placement on a mattress positioned on a box spring and forming an assembly therewith, said item of bed clothes having a top edge, a bottom edge and a pair of side edges, the retainer vice comprising:

(A) a retaining flap of flexible sheet material having one edge attached to the item of bedclothes along a transverse line located in relative relationship to the bottom edge of the item of bedclothes and extending from the attached edge in the same direction as the bottom edge, said flap having a transverse elongated pocket extending along the opposite edge of the flap;

(B) an elongated filler member removeably positioned within the pocket to form an elongated transverse rib configuration of greater thickness than the sheet material of the flap;

(C) the retaining flap extending a sufficient distance relative to the bottom edge of the item of bedclothes that when the item of bedclothes is placed in operative position on a mattress, it will extend down over the bottom edge of the mattress and between the mattress and box spring; and (D) a retaining band extending transversely across the retaining flap and securely mounted on the mattress to bear against the retaining flap and retard movement thereof.

8. The combination claimed in claim 7, wherein the item of bedclothes having the retaining flap is a bottom sheet.

9. The combination claimed in claim 7, wherein the item of bedclothes having the retaining flap is a top sheet.

10. The combination claimed in claim 7, wherein the item of bedclothes having the retaining flap includes both a top and bottom sheets.

11. The combination claimed in claim 7, wherein the retaining flap is stitched to the item of bedclothes.

12. The combination claimed in claim 7, wherein the retaining flap is formed integrally with the item of bedclothes.

13. The combination claimed in claim 7, wherein the filler member is of tubular construction.

14. The combination claimed in claim 7, wherein the filler member is solid in cross-section.

15. The combination claimed in claim 7, wherein the retaining band completely encircles the mattress in the transverse direction.

16. The combination claimed in claim 7, wherein the item of bedclothes is a bottom sheet having a retaining flap extending from both the top and bottom edge of the sheet and wherein a retaining band extends transversely across each of the retaining flaps.

17. The combination claimed in claim 7 wherein the retaining flap is attached to the item of bedclothes at the bottom edge thereof.

18. The combination claimed in claim 7 wherein the retaining flap is attached to the bottom side of the item of bedclothes at a spaced distance from the bottom edge thereof.

* * * * *